US010324412B2

(12) United States Patent
Takaba

(10) Patent No.: US 10,324,412 B2
(45) Date of Patent: Jun. 18, 2019

(54) IMAGE FORMING APPARATUS

(71) Applicant: CANON KABUSHIKI KAISHA, Tokyo (JP)

(72) Inventor: Ryo Takaba, Odawara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/156,237

(22) Filed: Oct. 10, 2018

(65) Prior Publication Data

US 2019/0041789 A1 Feb. 7, 2019

Related U.S. Application Data

(63) Continuation of application No. 15/817,401, filed on Nov. 20, 2017, now Pat. No. 10,120,325.

(30) Foreign Application Priority Data

Nov. 25, 2016 (JP) ..... 2016-229216

(51) Int. Cl.
*G03G 21/12* (2006.01)
*G03G 21/10* (2006.01)
(Continued)

(52) U.S. Cl.
CPC ..... *G03G 21/12* (2013.01); *G03G 15/095* (2013.01); *G03G 15/5008* (2013.01);
(Continued)

(58) Field of Classification Search
CPC ..... G03G 21/12; G03G 21/10; G03G 21/105; G03G 21/169; G03G 21/0064;
(Continued)

(56) References Cited

U.S. PATENT DOCUMENTS

2011/0097124 A1 4/2011 Koike et al.
2015/0227108 A1 8/2015 Ueda et al.
2016/0033904 A1* 2/2016 Izumi ..... G03G 21/105 399/358

FOREIGN PATENT DOCUMENTS

JP H01239580 A 9/1989
JP 2007057579 A 3/2007
(Continued)

OTHER PUBLICATIONS

Notice of Allowance issued in U.S. Appl. No. 15/817,401 dated Jul. 9, 2018.

*Primary Examiner* — Joseph S Wong
(74) *Attorney, Agent, or Firm* — Rossi, Kimms & McDowell LLP

(57) ABSTRACT

An image forming apparatus includes an image bearing member, a charging unit, a developing unit, a transfer unit, a residual developer collecting container, a developer feeding unit, a driving unit configured to drive the developer feeding unit and at least one of the image bearing member, the developing unit and the transfer unit, and a control unit configured to change a driving speed of the driving unit depending on a storing amount of the residual developer in the collecting container in a period from an end of formation of an image on a first recording material to a start of formation of the image on a second recording material subsequent to the first recording material.

20 Claims, 6 Drawing Sheets

(51) Int. Cl.
*G03G 21/16* (2006.01)
*G03G 15/095* (2006.01)
*G03G 15/00* (2006.01)

(52) U.S. Cl.
CPC ..... *G03G 21/10* (2013.01); *G03G 21/105* (2013.01); *G03G 15/553* (2013.01); *G03G 15/556* (2013.01); *G03G 21/169* (2013.01); *G03G 2221/0005* (2013.01); *G03G 2221/1627* (2013.01)

(58) Field of Classification Search
CPC ..... G03G 15/095; G03G 15/5008; G03G 15/553; G03G 15/556; G03G 15/0822; G03G 2221/0005; G03G 2221/1627
See application file for complete search history.

(56) References Cited

FOREIGN PATENT DOCUMENTS

| | | | |
|---|---|---|---|
| JP | 2010054904 | A | 3/2010 |
| JP | 2012242638 | A | 12/2012 |

* cited by examiner

IMAGE FORMING APPARATUS

FIELD OF THE INVENTION AND RELATED ART

The present invention relates to an image forming apparatus, particularly the image forming apparatus in which feeding of residual toner is controlled.

In the image forming apparatus of an electrophotographic type, toner is deposited on a photosensitive drum correspondingly to an image intended to be printed, and thereafter, printing is carried out by transferring the toner onto a sheet. However, 100% of the toner is not completely transferred onto the sheet. The toner in some amount is not transferred onto the sheet and is deposited on the photosensitive drum as it is. This toner remaining on the photosensitive drum is referred to as residual toner. When the residual toner is left standing on the photosensitive drum as it is, the residual toner is transferred onto a subsequent sheet as it is in some cases and causes an image defect. For that reason, the residual toner is removed from the photosensitive drum and is collected in a residual toner container.

In order to downsize the image forming apparatus, the residual toner container employs various constitutions in some cases. As one of the constitutions, there is a constitution such that a residual toner collecting container which temporarily holds the residual toner removed from the photosensitive drum and which has a small volume, and a residual toner feeding screw for feeding the residual toner from the residual toner collecting container toward a residual toner storing container are provided. However, there is a limit to a feeding amount of the residual toner feeding screw and therefore, there is a need to always grasp an amount of the residual toner. For example, in Japanese Laid-Open Patent Application (JP-A) 2007-57579, the amount of the residual toner removed from the photosensitive drum is predicted by a print ratio of a toner image on the sheet and a transfer efficiency of the toner image, so that the amount of the residual toner stored in the residual toner container is acquired.

In a conventional image forming apparatus, for the purpose of manufacturing the image forming apparatus more inexpensively, in some cases, a constitution in which a driving source (i.e., a motor) is common to the residual toner feeding screw and a developing device is employed. In such a constitution, in many cases, the container overflowing with the residual toner is not the residual toner storing container for storing the residual toner, but is the residual toner collecting container for collecting and temporarily accommodating the residual toner. A storing amount of the residual toner in the residual toner collecting container is determined by a relationship between a discharge amount of the residual toner removed from the photosensitive drum and the residual toner feeding amount of the residual toner feeding screw. When the residual toner discharging amount is larger than the residual toner driving amount, the amount of the residual toner in the residual toner collecting container continuously increases. As regards the residual toner discharging amount, as disclosed in JP-A 2007-57579, the residual toner discharging amount can be predicted by the print ratio and the transfer efficiency.

In the case of continuous printing, particularly in the case where printing with a high print ratio at which the residual toner discharging amount is large is continued, the residual toner collecting container having the small volume overflows with the residual toner in some instances. In order to prevent overflowing with the residual toner during the continuous printing, there is a need that a period (sheet interval) between printing of the images on a sheet and a subsequent sheet during the continuous printing is extended (increased) and the residual toner feeding screw is driven in the period. However, in the case where an accurate amount in which the continuous printing can be continued without causing the overflowing with the residual toner when the residual toner is fed at which speed is not known, the sheet interval is required to be set at a large value or to be extended, so that the residual toner has to be fed from the residual toner collecting container. When the sheet interval is set at the large value or extended, productivity of the printing lowers. In order to reduce a cost, in the case where the residual toner feeding screw is driven by the same driving source as an image forming mechanism, a lifetime of the image forming mechanism is to be consumed. The lifetime of the image forming mechanism refers to a time of use of the image forming mechanism on design assumption, and the consumption of the lifetime refers to an increase of the time of use of the image forming mechanism (i.e., cumulative use).

SUMMARY OF THE INVENTION

The present invention has been accomplished in the above-described circumstances.

A principal object of the present invention is to provide an image forming apparatus capable of preventing a residual toner collecting container from overflowing with residual toner while suppressing a decrease in lifetime of an image forming mechanism to a minimum even in the case where a driving source of the image forming mechanism and a driving source of a residual toner feeding screw are the same.

According to an aspect of the present invention, there is provided an image forming apparatus comprising: an image bearing member; a charging unit configured to electrically charge the image bearing member; a developing unit configured to deposit a developer on a surface of the charged image bearing member; a transfer unit configured to transfer the developer from the image bearing member onto a recording material; a collecting container configured to collect a residual developer remaining on the surface of the image bearing member without being transferred onto the recording material; a developer feeding unit configured to feed, from the collecting container, the residual developer collected in the collecting container; a driving unit configured to drive the developer feeding unit and at least one of the image bearing member, the developing unit and the transfer unit; and a control unit configured to change a driving speed of the driving unit depending on a storing amount of the residual developer in the collecting container in a period from an end of formation of an image on a first recording material to a start of formation of the image on a second recording material subsequent to the first recording material.

Further features of the present invention will become apparent from the following description of exemplary embodiments with reference to the attached drawings.

DESCRIPTION OF EMBODIMENTS

Embodiments of the present invention will be specifically described with reference to the drawings.

[Embodiment 1]

[Image Forming Apparatus]

Figure 1A:
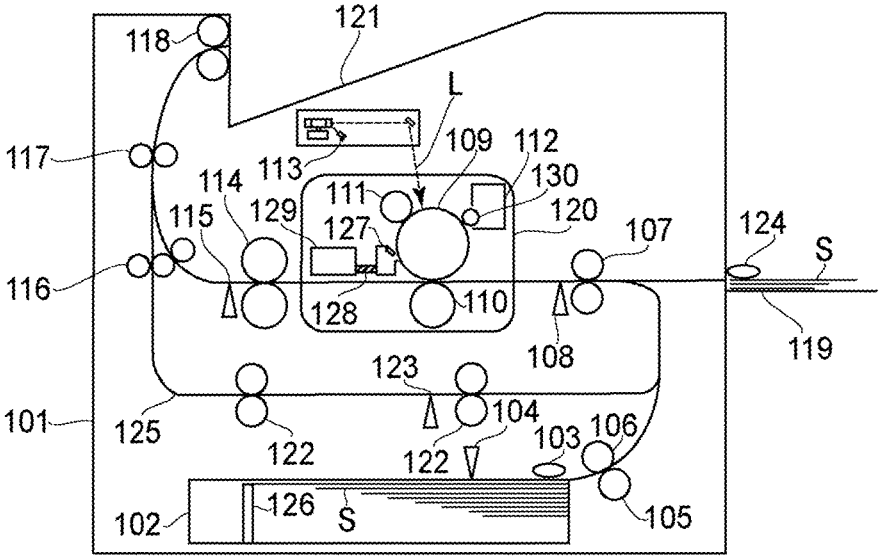
FIG. 1A is a schematic structural view of an image forming apparatus in Embodiment 1.
Figure 1B:
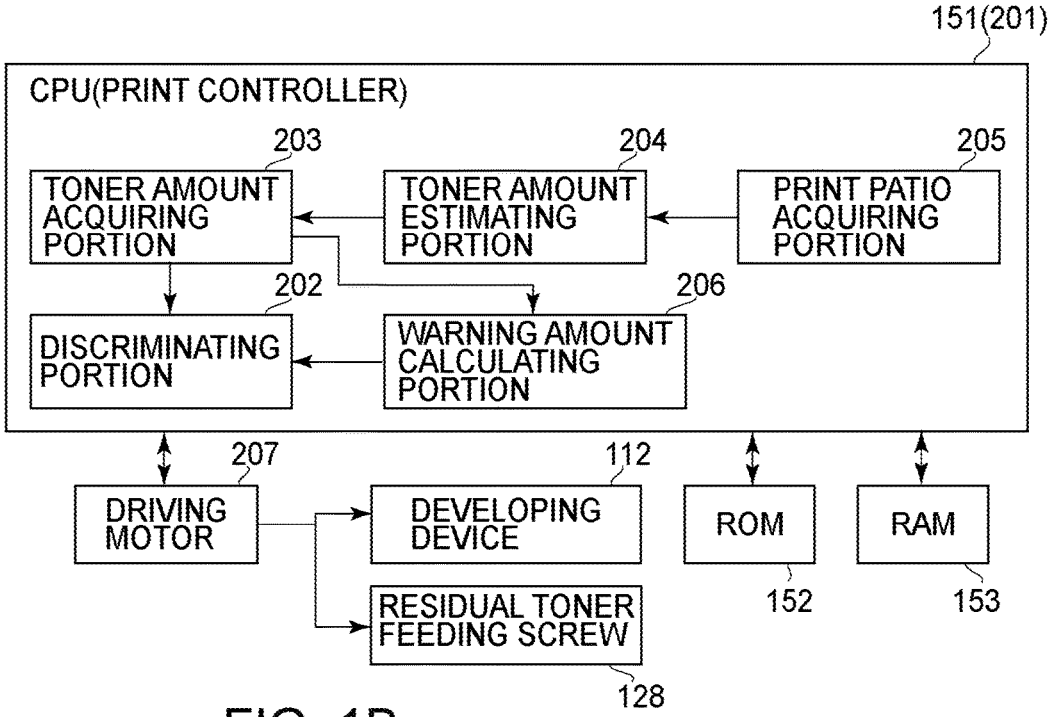
FIG. 1B is a control block diagram of the image forming apparatus.

Part (a) of FIG. 1 is a schematic structural view of an image forming apparatus 101 in this embodiment. As the image forming apparatus 101 in this embodiment, a laser beam printer will be described as an example. In the laser beam printer, when an instruction to form an image (printing) is provided from a video controller, preliminary preparation of the printing is started.

As the preliminary preparation of the printing, actuation of respective actuators, a laser scanner 113 which is an exposure device, an image forming portion 120, and a fixing roller 114 is carried out. When the preliminary preparation is completed, a sheet S as a recording material (medium) is fed from a sheet (paper) feeding cassette 102 which is a recording material holding portion. In the sheet feeding cassette 102, presence or absence of the sheet S is detected by a sheet (paper) presence/absence sensor 104, and a position of the sheet S with respect to a sheet feeding direction is regulated by a regulating portion 126. When the sheet S is fed from the sheet feeding cassette 102, a pick-up roller 103 is driven and feeding of the sheet S is started. The fed sheet S is conveyed by a feed roller 106 and a registration roller pair 107 and reaches a top sensor 108. A separation roller 105 is a separating means for separating the fed sheet S and separates an uppermost sheet S, in the sheet feeding cassette 102, from sheets S which are second and subsequent sheets S fed together with the uppermost sheet S by the pick-up roller 103, and thus feeds only the uppermost sheet S to a feeding path.

The sheet feeding can also be performed from a multi-sheet feeding tray 119. When the sheet is fed from the multi-sheet feeding tray 119, the sheet S is fed by driving a pick-up roller 124. The fed sheet S is conveyed by the registration roller 107 and reaches the top sensor 108. When a leading end of the sheet S is detected by the top sensor 108, the sheet S is conveyed to an image forming portion 120.

The image forming portion 120 as an image forming mechanism includes a photosensitive drum 109 as an image bearing member, a transfer roller 110 as a transfer unit, a charging roller 111 as a charging unit and a developing device 112 as a developing unit. The developing device 112 in this embodiment employs a jumping development type, and a developing roller 130 included in the developing device 112 is provided at a position where the developing roller 130 does not contact the photosensitive drum 109. The image forming portion 120 further comprises a residual toner collecting container 127 as a collecting container, a residual toner feeding screw as a developer feeding unit, and a residual toner storing container 129. In the following, the residual toner collecting container 127 is referred to as the collecting container 127, the residual toner feeding screw 128 is referred to as the feeding screw 128, and the residual toner storing container 129 is referred to as the storing container 129.

The image forming portion 120 is driven by a driving motor 207 as a driving unit (part (b) of FIG. 1). In this embodiment, the developing device 112 and the feeding screw 128 are mechanically connected with each other by gears, and are driven by the driving motor 207 which is a common driving source. When the developing device 112 is driven by the driving motor 207, the developing roller 130 is rotated. A lifetime of the developing roller 130 (lifetime of the developing device 112) is acquired by a CPU 151, shown in part (b) of FIG. 1, on the basis of a rotation time.

The photosensitive drum 109 is electrically charged uniformly by the charging roller 111, and is irradiated with laser light L outputted from the laser scanner 113, so that an electrostatic latent image is formed on the surface of the photosensitive drum 109. The thus-formed electrostatic latent image is visualized as a toner image by depositing toner as a developer on the photosensitive drum surface by the developing device 112. Then, the photosensitive drum 109 is rotates, so that not only the toner image is fed to a transfer position, but also the sheet S is fed to the transfer position in synchronism with rotation of the photosensitive drum 109. At the transfer position, a voltage of an opposite polarity to a charge polarity of the toner image is applied to the transfer roller 110, so that the toner image is transferred onto the sheet S in a predetermined position.

At this time, residual toner (residual developer) remaining on the surface of the photosensitive drum 109 without being transferred is collected first in the collecting container 127. The residual toner collected in the collecting container 127 is fed toward the storing container 129 by the feeding screw 128, so that the residual toner is stored in the storing container 129. The storing container 129 has a larger volume than the collecting container 127 and thus is capable of storing the residual toner in a larger amount than the storing container 129.

The sheet S on which the toner image is transferred is conveyed to the fixing roller 114. By the fixing roller 114, the sheet S is heated and pressed, so that the toner image is fixed on the sheet S. The sheet S on which the fixing of the toner image is completed is detected by a fixing sensor 115. The sheet S on which the toner image is fixed is conveyed by triple rollers 116, an intermediary roller pair 117 and a discharging roller pair 118, and is discharged onto a tray 121. Thus, a series of printing processes is carried out.

In the case where printing of images on double sides (both surfaces) of the sheet S (i.e., double-side-printing), after a trailing end of the sheet S on which the image is printed on one surface (side) as described above passed through the triple rollers 116 the intermediary roller pair 117 and the discharging roller pair 118 are reversely rotated. The sheet S reaches a feeding path 125 for double-side-printing and is fed by a roller pair 122 for double-side-printing, and is detected by a feeding sensor 123 for double-side-printing, and thereafter is stopped. At timing when re-feeding of the sheet S for double-side-printing of the image on the other surface (side) is performed, the stopped sheet S is conveyed by the roller pair 122 for double-side-printing and then reaches the top sensor 108. Subsequent print control for printing the image on the other surface is similar to that in the above-described case of printing the image on one surface. A series of these processes is controlled by a print controller as a control unit described later. In part (a) of FIG.

1, a single image forming portion 120 is illustrated, but the image forming apparatus 101 may also include a plurality of image forming portions 120.

[Block Diagram of Image Forming Apparatus]

Part (b) of FIG. 1 is a control block diagram of the image forming apparatus 101 in this embodiment. The image forming apparatus 101 includes the CPU 151 which is a central processing unit, a ROM 152 which is a storing device, and a RAM 153 which is a storing device. The CPU 151 controls respective operations of the image forming apparatus 101 while using the RAM 153 as a working area in accordance with various programs stored in the ROM 152. Further, CPU 151 has a timer function and is capable of measuring a time.

The CPU 151 functions as a print controller 201 which is a control unit. The print controller 201 includes, as shown in part (b) of FIG. 1, a control discriminating portion 202, a residual toner amount acquiring portion 203 as an acquiring unit, a residual toner amount estimating portion 204 as an estimating unit, a print ratio acquiring portion 205, and a residual toner warning amount calculating portion 206 as a calculating unit. The CPU 151 may effect not only control regarding the print controller 201 but also centralized control of an entirety of the image forming apparatus 101. Similarly, also as regards the ROM 152 and the RAM 153, these storing devices may be used exclusively for the print controller 201 and may also be common to the print controller 201 and another constitution, of the image forming apparatus 101, other than the print controller 201.

The print controller 201 controls the driving motor 207 as a driving unit, and the driving motor 207 is connected with the developing device 112 and the feeding screw 128. The developing device 112 and the feeding screw 128 are driven in interrelation with drive (drive: ON) or stop of the drive (drive: OFF) of the driving motor 207. In the case where the drive of the driving motor 207 stops, the developing roller 130 does not contact the photosensitive drum 109 and therefore, even when the photosensitive drum 109 is rotated by an unshown another driving source, the developing roller 130 is not rotated by the photosensitive drum 109. Therefore, a lifetime of the developing roller 130 is not shortened.

The print ratio acquiring portion 205 has a function of acquiring a print ratio, of an image printed on a subsequent sheet S, from print data for the subsequent sheet S. The residual toner amount estimating portion 204 has a function of acquiring, from the print ratio acquiring portion 205, the print ratio of the image printed on the subsequent sheet S. The residual toner amount estimating portion 204 has a function of estimating an amount (storing amount) of the residual toner stored in the collecting container 127 by using the acquired print ratio, a transfer efficiency of the residual toner from the surface of the photosensitive drum 109 onto the subsequent sheet S, and the like. The residual toner amount acquiring portion 203 has a function of acquiring the storing amount of the residual toner estimated by the residual toner amount estimating portion 204.

The residual toner warning amount calculating portion 206 has a function of calculating a residual toner warning amount from a full load amount of the collecting container 127 and the storing amount of the residual toner acquired by the residual toner amount acquiring portion 203. The full load amount of the collecting container 127 is a value uniquely determined by an amount of the residual toner storable by the collecting container 127 and is hereinafter referred to as a residual toner full load amount. When the residual toner is loaded in the collecting container 127 in an amount exceeding the residual toner full load amount, the collecting container 127 overflows with the residual toner in some cases.

The residual toner warning amount is value at which a total amount (total storing amount) of the residual toner stored in the collecting container 127 does not exceed the residual toner full load amount in the case where the printing of the image on the subsequent sheet S is carried out. For example, as the residual toner warning amount, it is possible to set a value obtained by subtracting from the residual toner full load amount, an amount (collected amount) of the residual toner collected in the case where the image is printed on the subsequent sheet S.

At this time, there are cases where the print ratio of the image printed on the subsequent sheet S is changed depending on a print region, for example, where the print region in which the print ratio is high and where the collecting amount of the residual toner acquired for an entirety of the sheet S and an actual collecting amount of the residual toner are different from each other. For that reason, in the case where a value obtained, from the residual toner full load amount, using the residual toner collecting amount acquired for the entirety of the sheet S is set at the residual toner warning amount, when the printing in the print region with a high print ratio is carried out, there is a possibility that the total storing amount of the residual toner exceeds the residual toner full load amount. In the case where printing with a localized print ratio is carried out, the residual toner collecting amount may also be acquired in advance from the print ratio for each of print regions. As the residual toner warning amount, a value obtained by subtracting this residual toner collecting amount from the residual toner full load amount can be set.

In the case where the print ratio in the printing of the image on the subsequent sheet S cannot be made at the time of the sheet feeding, from information known in advance, the residual toner collecting amount in the case where the image is printed on the subsequent sheet S is acquired and then the residual toner warning amount can be set. For example, the residual toner collecting amount on the assumption that the residual toner is generated in a largest amount can be acquired. Specifically, the residual toner collecting amount changes depending on the constitution of the image forming apparatus 101 in some cases, but it is possible to assume the case where the printing of the image on the sheet S is carried out with the print ratio of 100%. Further, as the residual toner collecting amount, from the residual toner collecting amount when the image is printed on the sheet S on which the printing of the image has been ended, it is also possible to set an average of residual toner collecting amounts per sheet S.

The control discriminating portion 202 has a function of discriminating whether or not what control mode should be selected from a plurality of control modes described later, on the basis of the residual toner storing amount acquired from the residual toner amount acquiring portion 203 and the residual toner warning amount acquired from the residual toner warning amount calculating portion 206. The control discriminating portion 202 changes a driving speed of the driving motor 207 depending on the selected control mode. The change of the driving speed referred to herein includes ON/OFF control of the drive and control of changing the driving speed.

Even in the case where the residual toner storing amount exceeds the residual toner warning amount, the driving motor 207 may also be not driven in a sheet interval. Specifically, such a case is that there is no sheet S subsequent to the subsequent sheet S and the residual toner storing amount does not exceed to volume (full load amount) of the collecting container 127 even when the collecting amount of the residual toner which is generated by the printing of the image on the subsequent sheet S and which is collected is added to the residual toner storing amount. That is, in the case where it is possible to discriminate that there is no overflowing of the residual toner from the collecting container 127 even when the printing of the image on the final sheet S is carried out in the continuous printing, in the sheet interval, the driving motor 207 may also be not driven.

[Drive of Motor During Print Control]

Figure 2:
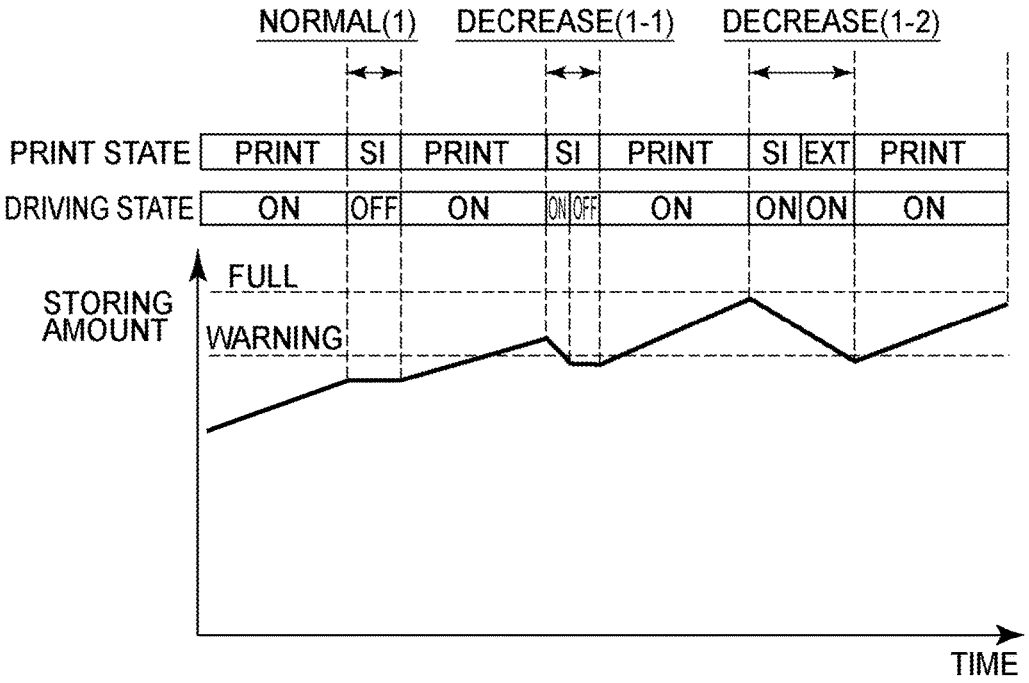
FIG. 2 is a time chart of print control in Embodiment 1.

Next, with reference to FIG. 2, a change, with time, of the print control in the image forming apparatus 101 in this embodiment will be described. FIG. 2 is a time chart of the print control in this embodiment. In FIG. 2, the change, with time, of the residual toner storing amount of the collecting container 127 depending on a print state and a state (driving state) of the driving motor 207 in the case where the continuous printing is carried out. In FIG. 2, the full load amount and the warning amount of the residual toner in the collecting container 127 are indicated by broken lines parallel to the abscissa (time axis).

In FIG. 2, as the print state, a period between printing and subsequent printing is shown as the sheet interval. The sheet interval refers to a period from an end of formation of the image on a first sheet S to a start of formation of the image on a second sheet S subsequent to the first sheet S. Specifically, the sheet interval is a time (period) from passing of the trailing end of the first sheet S through the photosensitive drum 109 with respect to the sheet feeding direction until the leading end of the subsequent second sheet S passes through the photosensitive drum 109.

In this embodiment, the control mode of the print control is selected from three control modes consisting of normal control (1), residual toner decrease control (1-1) and residual toner decrease control (1-2). As regards these control modes, the control discriminating portion 202 discriminates control, to be carried out, on the basis of a length of a driving time of the driving motor 207 necessary to change the storing amount of the collecting container 127 to the residual toner warning amount or less.

The driving time necessary for the driving motor 207 is calculated by the control discriminating portion 202 by using the residual toner amount of the collecting container 127 estimated by the residual toner amount estimating portion 204 and the residual toner warning amount calculated by the residual toner warning amount calculating portion 206. The calculation of the driving time of the driving motor 207 can be performed in the following manner.

(Calculation of Driving Time)

Here, a toner amount on a page during current (present) printing is PrTnr (g), an untransfer efficiency of the toner (image) is $\sigma t$, a length of the sheet S with respect to the feeding direction is Leng (mm), and a feeding speed of the sheet S is PrSpd (mm/s). Further, a feeding amount (feeding speed) per unit time of the feeding screw 128 is TsDelSpd (mm/s). A collecting amount PrDisTnr of the residual toner generated by the printing of the image on the sheet S during the current printing is acquired by the following formula (101).

$$\text{PrDisTnr}=(\text{PrTnr}\times\sigma t)-\text{TsDelSpd}\times(\text{Leng}/\text{PrSpd}) \quad (101)$$

When the amount of the residual toner stored in the collecting container 127 until the last printing is BefDisTnr (g), a total storing amount TotalDisTnr (g) after the end of the printing of the image on the current sheet S is acquired by the residual toner amount estimating portion 204 according to the following formula (102).

$$\text{TotalDisTnr}=\text{BefDisTnr}+\text{PrDisTnr} \quad (102)$$

When the residual toner warning amount is DisTnrWarm (g), a driving time NeedTsOnTime (s) necessary to change the storing amount, of the residual toner in the collecting container 127, acquired by the residual toner amount acquiring portion 203 to the residual toner warning amount or less is acquired by the following formula (103).

$$\text{NeedTsOnTime}=(\text{TotalDisTnr}-\text{DisTnrWarn})/\text{TsDelSpd} \quad (103)$$

When the sheet interval in the case of the normal control is IntTime (s), the control mode in the sheet interval can be changed based on three ranges shown by the following formulas (104), (105) and (106).

$$\text{NeedTsOnTime}\leq 0 \quad (104)$$

$$0<\text{NeedTsOnTime}<\text{IntTime} \quad (105)$$

$$\text{NeedTsOnTime}\geq\text{IntTime} \quad (106)$$

In the case where the formula (104) holds, as the control mode, the normal control (1) is selected by the control discriminating portion 202. In the case where the formula 104 holds, the residual toner amount is not more than the residual toner warning amount, and therefore, there is no need to additionally drive the feeding screw 128. For that reason, in the sheet interval, the drive of the driving motor 207 is off.

In the case where the formula (105) holds, as the control mode, the residual toner decrease control (1-1) is selected by the control discriminating portion 202. In the case where the formula (105) holds, there is a need to drive the driving motor 207 in order to change the storing amount of the collecting container 127 to the residual toner warning amount or less, so that the driving time of the driving motor 207 is shorter than that in the case of the normal control. For that reason, the drive of the driving motor 207 is still on subsequently to the printing operation before a start of the sheet interval. After the residual toner storing amount decreases to the residual toner warning amount or less, the drive of the driving motor 207 is turned off and is off until an end of the sheet interval. At this time, although the drive of the driving motor 207 is on in a part of the sheet interval, the sheet interval is the same as that in the case of the normal control, and therefore, productivity of the continuous printing does not lower.

In the case where the formula (106) holds, as the control mode, the residual toner decrease control (1-2) is selected by the control discriminating portion 202. In the case where the formula (106) holds, the driving time NeedTsOnTime of the driving motor 207 necessary to change the residual toner storing amount of the collecting container 127 to the residual toner warning amount or less is longer than that in the case of the normal control. For that reason, the drive of the driving motor 207 is still on subsequently to the printing operation before the start of the sheet interval and the driving time of the driving motor 207 is further extended from the sheet interval IntTime in the case of the normal control. The extended driving time corresponds to a difference between the above-described driving time NeedTsOnTime of the driving motor 207 and the sheet interval IntTime in the case of the normal control.

[Print Control Process]

Figure 3:
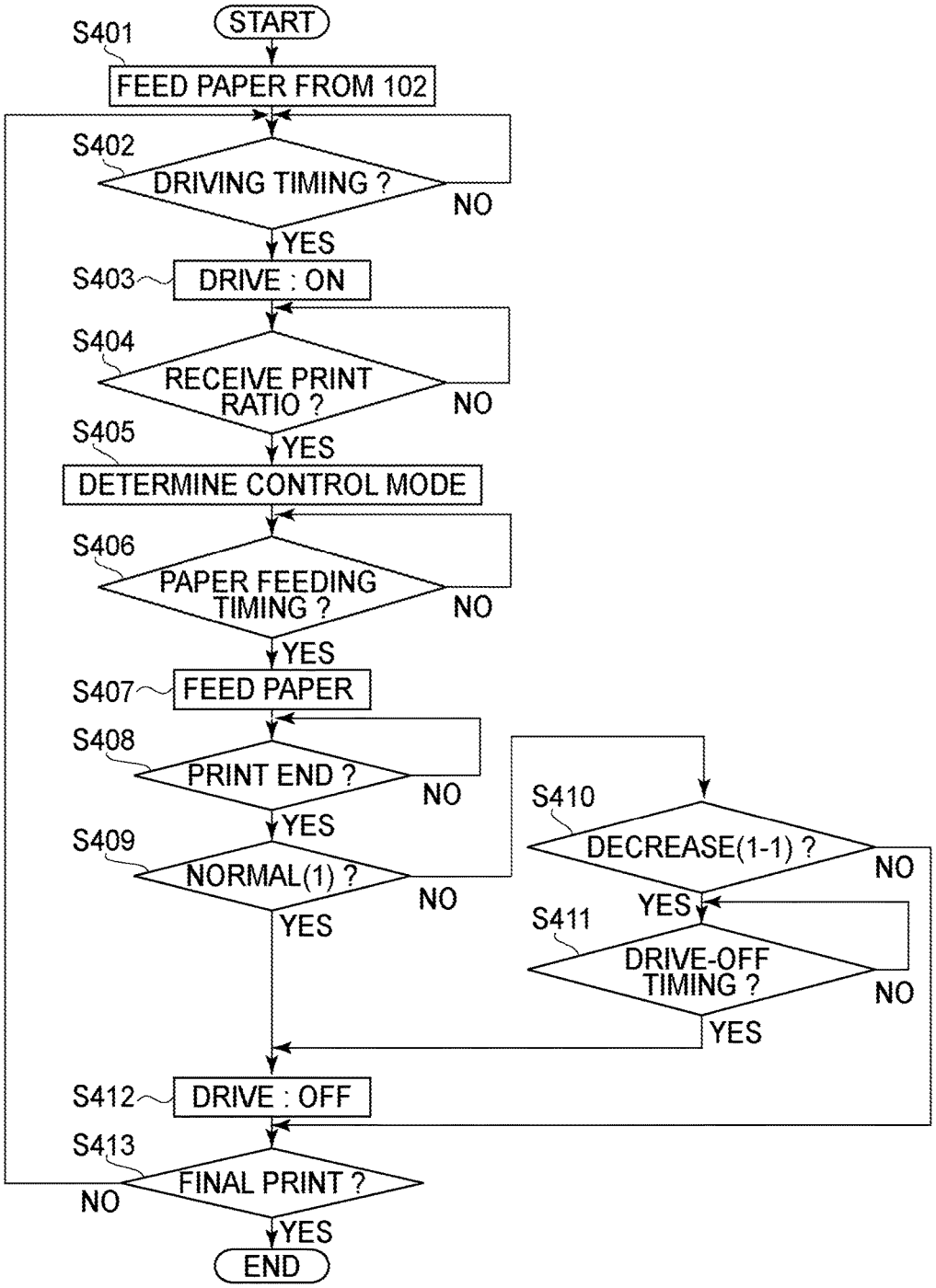
FIG. 3 is a flowchart of the print control in Embodiment 1.

A print control process in this embodiment will be described. FIG. 3 is a flowchart of the print control in this embodiment. When the print control process is started, in a step S401, the print controller 201 feed the sheet (paper) from the sheet feeding cassette 102.

In S402, the print controller 201 discriminates whether or not timing is timing when the developing device 112 starts the printing, i.e., timing when the drive of the driving motor 207 is started in this embodiment. When the print controller 201 discriminates that the timing is not the timing when the developing device 112 starts the printing, the print controller 201 returns the process to S402. In S402, in the case where the print controller 201 discriminated that the timing is the timing when the developing device 112 starts the printing, the print controller 201 causes the process to go to S403, and turns the drive of the driving motor 207 on.

Then, in S404, the print controller 201 discriminates whether or not the print ratio, of the image on the fed sheet S, acquired by the print ratio acquiring portion 205 was received. In the case where the print controller 201 discriminated that the print ratio was not received, the print controller 201 returns the process to S404. In the case where the print controller 201 discriminated in S404 that the print ratio was received, the print controller 201 causes the print controller to go to S405, and causes the control discriminating portion 202 to determine the control mode. The method for determining the control mode is as described above.

After the drive of the driving motor 207 is started, in S406, the print controller 201 discriminates whether or not timing is timing when the subsequent sheet S is fed so that the sheet interval is the sheet interval in accordance with the operation in the control mode determined in S405. In the case where the print controller 201 discriminated that the timing was not the timing when the subsequent sheet S was fed, the print controller returns the process to S406. In the case where the print controller 201 discriminated that the timing was the timing when the subsequent sheet S was fed, the print controller 201 causes the process to go to S407, and the sheet feeding is performed in S407. In S408, the print controller 201 discriminates whether or not the printing of the image on the sheet S is ended. In the case where the print controller 201 discriminated that the printing was not ended, the print controller 201 returns the process to S408, and in the case where the print controller 201 discriminated that the printing was ended, the print controller 201 causes the process to go to S409.

In S409, the print controller 201 discriminates whether or not the control mode determined in S405 is the normal control (1). In the case where the print controller 201 discriminated that the control mode was the normal control (1), the print controller 201 turns the drive of the driving motor 207 off instantaneously in S412, and causes the process to go to S413.

In S409, in the case where the print controller 201 discriminated that the control mode was not the normal control (1), in S410, the print controller 201 discriminates whether or not the control mode determined in S405 is the residual toner decrease control (1-1). In the case where the print controller 201 discriminated that the control mode was the residual toner decrease control (1-1), the print controller 201 causes the process to go to S411. In S411, the print controller 201 discriminates whether or not timing is timing when the drive of the driving motor 207 is turned off. In the case where the print controller 201 discriminated that the timing was not the timing when the drive of the driving motor 207 was turned off, the print controller 201 causes the process to go to S411. In the case where the print controller 201 discriminated that the timing was the timing when the drive of the driving motor 207 turns the drive of the driving motor 207 off is S412, and thereafter causes the process to go to S413.

In S410, the print controller 201 discriminated that the control mode determined in S405 was not the residual toner decrease control (1-1) but was the residual toner decrease control (1-2), the print controller 201 causes the process to go to S413. In this case, as shown in FIG. 2, the drive of the driving motor 207 is not turned off in a period from the end of the formation of the image on a certain sheet S until the formation of the image on a subsequent sheet S starts.

In S413, the print controller 201 discriminates whether or not the printing operation of the image on the sheet S was a final printing operation in the continuous printing. In the case where the print controller 201 discriminated that the printing operation was the final printing operation, the print controller 201 ends the process. In the case where the print controller 201 discriminated that the printing operation was not the final printing operation but was a printing operation of the image on the subsequent sheet S, the print controller 201 returns the process to S402.

As described above, according to this embodiment, the residual toner storing amount of the collecting container 127 is checked for each printing of the image on the sheet S, so that control of the driving motor 207 in the sheet interval can be optimized. As a result, it is possible to prevent the collecting container 127 from overflowing with the residual toner while suppressing a degree of shortening of the lifetime of the developing device 112 to a minimum.

[Embodiment 2]

An image forming apparatus in Embodiment 2 will be described. The image forming apparatus in this embodiment can be illustrated using a schematic structural view, a control block diagram and a flowchart which are similar to those in Embodiment 1, and therefore will be omitted from redundant description. In the image forming apparatus in this embodiment, a drive transition time of the driving motor 207 is long. Here, the drive transition time refers to a time elapsed from reception, by the driving motor 207, of an instruction from the print controller 201 to turn on and off the driving motor 207 until the drive and a stop of the drive of the developing device 112 and the feeding screw 128 as instructed are actually achieved. The instruction from the print controller 201 to the driving motor 207 also includes the turning-on and off, acceleration and deceleration of the drive.

[Case where Total Drive Transition Time is Shorter than Sheet Interval in Normal Control]

Figure 4A:
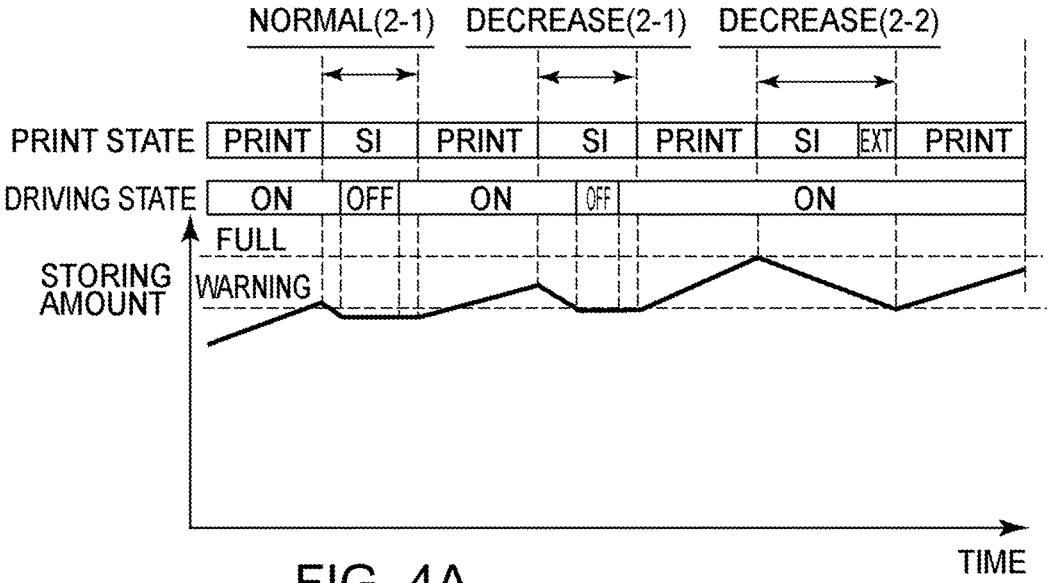
FIGS. 4A and 4B are time charts each showing print control in Embodiment 2.
Figure 4B:
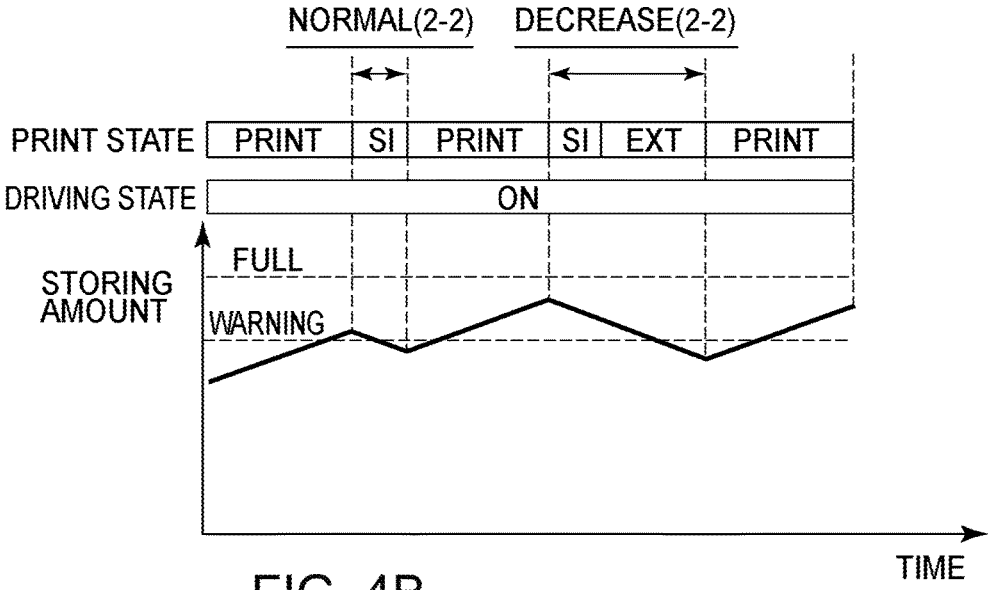

In the following, as regards the print control, a difference from Embodiment 1 will be principally described. Parts (a) and (b) of FIG. 4 are time charts each showing print control in Embodiment 2. In part (a) of FIG. 4, in this embodiment, the print control in the case where a time obtained by adding a drive transition time in the case where the drive of the driving motor 207 is turned on and a drive transition time in the case where the drive of the driving motor 207 is turned off (hereinafter, referred to as a total drive transition time) is shorter than the sheet interval in the normal control is shown. In this case, the print control (mode) is selected from three control modes consisting of normal control (2-1), residual toner decrease control (2-2) and residual toner decrease control (2-3).

In the case where the total drive transition time is shorter than the sheet interval in the normal control, a time in which the drive of the driving motor 207 is turned off can be provided in the sheet interval in the normal control. However, also during the drive transition time from turning-on to turning-off of the drive, the feeding screw 128 rotates and the storing amount of the residual toner in the collecting container 127 decreases, and therefore, the control is carried out in consideration thereof.

First, using the above-described formulas (101), (102) and (103), the residual toner amount estimating portion 204 calculates the total storing amount TotalDisTnr (g) of the residual toner after the printing of the image on the sheet S. Then, the control discriminating portion 202 calculates the necessary driving time NeedTsOnTime (s) of the driving motor 207. Here, the drive transition time in the case where the drive of the driving motor 207 is turned off is TrOffTime (s), and the drive transition time in the case where the drive of the driving motor 207 is turned on is TrOnTime (s). As a control condition, the control mode in the sheet interval can be determined based on three ranges shown by the following formulas (201), (202) and (203).

$$\text{NeedTsOnTime} \leq \text{TrOffTime} \tag{201}$$

$$\text{TrOffTime} < \text{NeedTsOnTime} < \text{IntTime} - \text{TrOnTime} \tag{202}$$

$$\text{NeedTsOnTime} \geq \text{IntTime} - \text{TrOnTime} \tag{203}$$

In the case where the formula (201) holds, as the control mode, the normal control (2-1) is selected by the control discriminating portion 202. In the normal control (2-1), the feeding screw 128 rotates during the drive transition time TrOffTime, so that the storing amount of the residual toner in the collecting container 127 decreases from a state of exceeding the residual toner warning amount to the residual toner warning amount or less. For that reason, there is no need to additionally drive the feeding screw 128. In the normal control (2-1), at timing in front of the end of the sheet interval by the drive transition time TrOnTime, an instruction from the print controller 201 to turn the drive the feeding screw 128 on is sent.

In the case where the formula (202) holds, as the control mode, the residual toner decrease control (2-1) is selected by the control discriminating portion 202. In the case where the formula (202) holds, the driving time NeedTsOnTime necessary to change the storing amount of the residual toner to the residual toner warning amount or less is longer than the drive transition time TrOffTime. For that reason, in the residual toner decrease control (2-1), there is a need to additionally drive the feeding screw 128. Further, the necessary driving time NeedTsOnTime is shorter than a time obtained by subtracting the drive transition time TrOnTime from the sheet interval in the normal control. That is, the necessary driving time NeedTsOnTime falls within the sheet interval in the normal control even in consideration of the "ON" drive transition time TrOnTime.

In the residual toner decrease control (2-1), after the printing of the image on the sheet S is ended, the drive is continued so that the sum of the driving times of the feeding screw 128 is the necessary driving time. After once the drive of the driving motor 207 is turned off, an instruction from the print controller 201 to turn the drive of the driving motor 207 on so that the transition to the "OFF" state of the drive of the driving motor 207 is completed when the printing of the image on the subsequent sheet S is started is sent. In the residual toner decrease control (2-1), the sheet interval is the same as that in the case of the normal control, and therefore, the productivity does not lower.

In the case where the formula (203) holds, as the control mode, the residual toner decrease control (2-2) is selected by the control discriminating portion 202. The residual toner decrease control (2-2), similarly as in the residual toner decrease control (2-1), the drive of the driving motor 207 is still on subsequently to the printing operation before the start of the sheet interval and the driving time of the driving motor 207 is further extended from the sheet interval IntTime in the case of the normal control. The extended driving time corresponds to a difference between the above-described driving time NeedTsOnTime of the driving motor 207 and the sheet interval IntTime in the case of the normal control.

[Case where Total Drive Transition Time is Equal to or Longer than Sheet Interval in Normal Control]

Part (b) of FIG. 4 shows print control in the case where the total drive transition time of the driving motor 207 is equal to or longer than the sheet interval in the normal control. In this case, the print control (mode) is selected from two control modes consisting of normal control (2-2) and residual toner decrease control (2-2).

In the case where the total drive transition time is equal to or longer than the sheet interval in the normal control, during the sheet interval in the normal control, the drive of the driving motor 207 cannot be turned off, so that the drive is kept on as it is. The control is carried out in consideration of two points that the residual toner storing amount decreases even in the sheet interval in the normal control (2-2) and that the residual toner decrease control (2-1) cannot be applied. As a control condition, the control mode in the sheet interval can be determined based on two ranges shown by the following formulas (204) and (205).

$$\text{NeedTsOnTime} \leq \text{IntTime} \tag{204}$$

$$\text{NeedTsOnTime} > \text{IntTime} \tag{205}$$

In the case where the formula (204) holds, as the control mode, the normal control (2-2) is selected by the control discriminating portion 202. Even when the residual toner storing amount exceeds the residual toner warning amount, the residual toner storing amount can be sufficiently decreased in the sheet interval in the normal control.

In the case where the formula (205) holds, as the control mode, the residual toner decrease control (2-2) is selected by the control discriminating portion 202. In the residual toner decrease control (2-2), similarly as in the above-described residual toner decrease control (1-2), the drive of the driving motor 207 is on subsequently to the printing operation before the start of the sheet interval, and the driving time of the driving motor 207 is further extended from the sheet interval IntTime in the case of the normal control. The extended driving time corresponds to a difference between the above-described necessary driving time NeedTsOnTime of the driving motor 207 and the sheet interval IntTime in the case of the normal control.

[Print Control Process]

Figure 5:
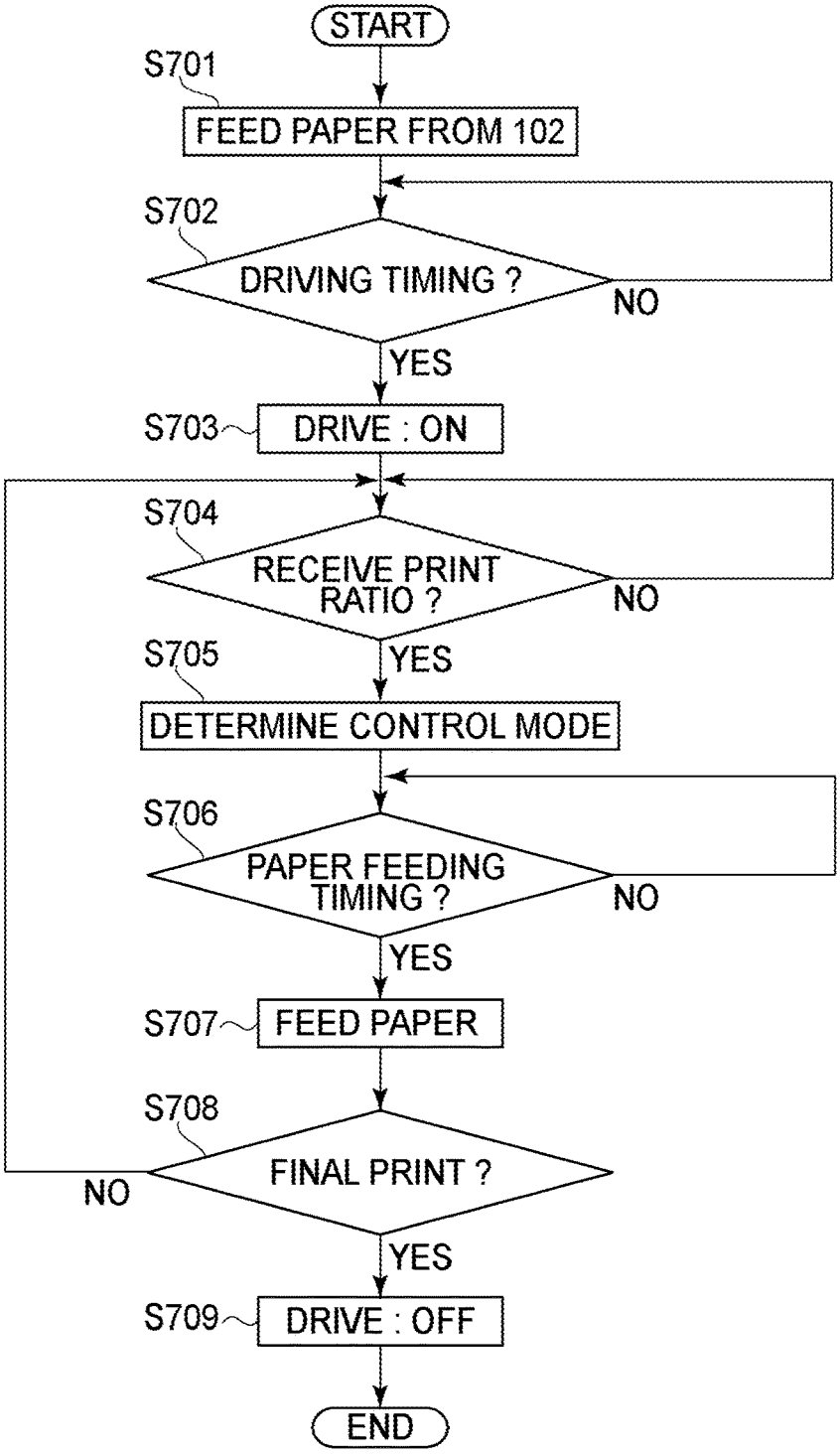
FIG. 5 is a flowchart of the print control in Embodiment 2.

FIG. 5 is a flowchart of the print control in this embodiment. FIG. 5 shows the print control in the case where the total drive transition time of the driving motor 207 is equal to or longer than the sheet interval in the normal control (i.e., in the case of part (a) of FIG. 4). Incidentally, the print control in the case where the total drive transition time of the driving motor 207 is shorter than the sheet interval in the normal control (i.e., in the case of (a) of FIG. 4) is similar to that of FIGS. 3. S701 to S707 are similar to S401 to S407, respectively, and therefore, will be omitted here from description.

After sheet feeding of the subsequent sheet S is carried out in S707, in S708he print controller 201 discriminates whether or not the printing operation of the image on the sheet S was a final printing operation in the continuous printing. In the case where the print controller 201 discriminated that the printing operation was the final printing operation, the print controller 201 ends the process after the drive of the driving motor 207 is turned off in S709. In the case where the print controller 201 discriminated that the printing operation was not the final printing operation but was a printing operation of the image on the subsequent sheet S, the print controller 201 returns the process to S704. In the print control of FIG. 5, as shown in part (b) of FIG. 4, the "ON" state of the drive of the driving motor 207 is maintained.

As described above, according to this embodiment, even in the case where the drive transition time is long, by optimizing the control of the driving motor 207, it is possible to prevent the collecting container 127 from overflowing with the residual toner while suppressing a degree of shortening of the lifetime of the developing device 112 to a minimum.

[Embodiment 3]

An image forming apparatus in Embodiment 3 will be described. The image forming apparatus in this embodiment can be illustrated using a schematic structural view and a flowchart which are similar to those in Embodiment 1, and therefore will be omitted from redundant description. In the image forming apparatus in this embodiment, the residual toner storing amount of the collecting container 127 is detected by a residual toner amount detecting sensor and the driving speed of the driving motor 207 in the sheet interval is changed, and the print ratio acquiring portion 205 is not provided. Control with these features will be described principally on the basis of a difference from other embodiments.

[Block Diagram of Image Forming Apparatus]

Figure 6A:
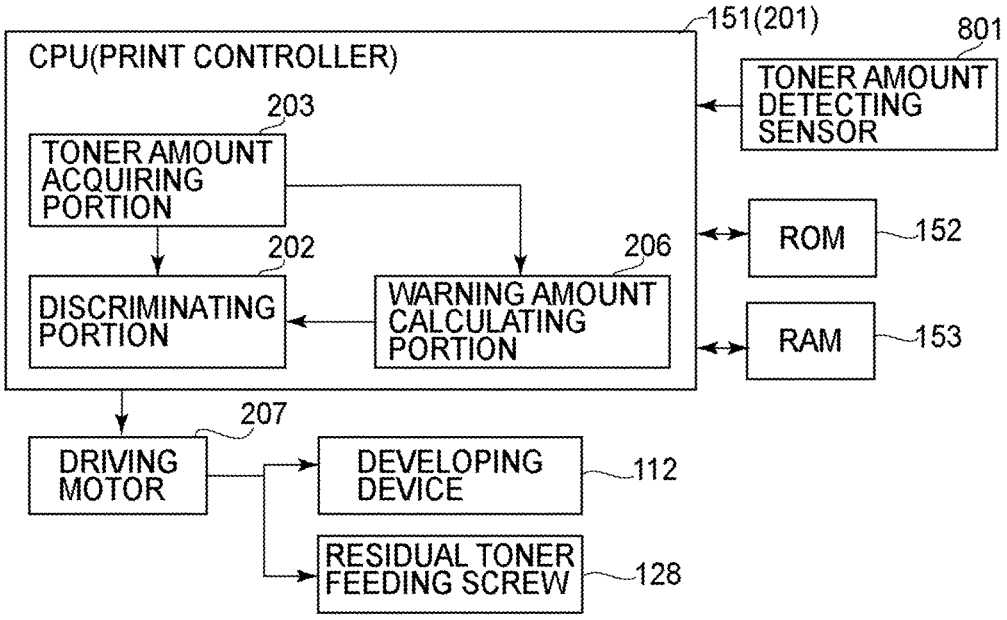
FIG. 6A is a control block diagram of an image forming apparatus in Embodiment 3.
Figure 6B:
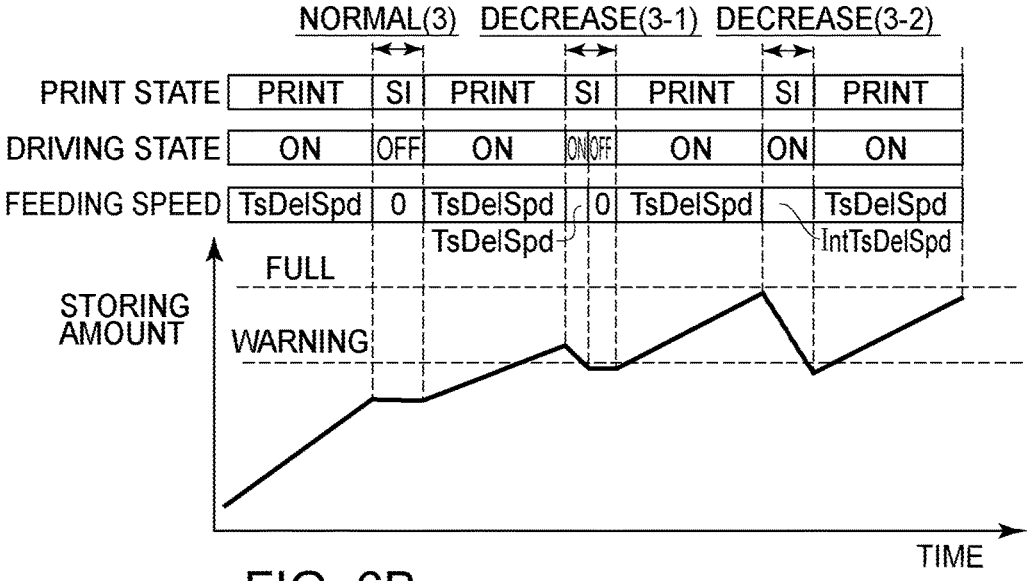
FIG. 6B is a time chart of a print control in Embodiment 3.

Part (a) of FIG. 6 is a control block diagram of the image forming apparatus in this embodiment. The print controller 201 includes, as shown in part (a) of FIG. 6, the control discriminating portion 202, the residual toner amount acquiring portion 203 and the residual toner warning amount calculating portion 206. The print controller 201 is connected with a residual toner amount detecting sensor 801. The residual toner amount acquiring portion 203 has a function of acquiring the residual toner amount from the residual toner amount detecting sensor 801. Other constitutions are the same as those in Embodiment 1.

[Drive of Motor During Print Control]

Part (b) of FIG. 6 is a time chart of the print control in this embodiment. In part (b) of FIG. 6, the change, with elapsed time, of the residual toner storing amount of the collecting container 127 depending on a print state, a driving state of the driving motor 207 and the feeding speed of the feeding screw 128, in the case of the continuous printing. In FIG. 2, the full load amount and the warning amount of the residual toner in the collecting container 127 are indicated by broken lines parallel to the abscissa (elapsed time axis).

In this embodiment, the control mode of the print control is selected from three control modes consisting of normal control (3), residual toner decrease control (3-1) and residual toner decrease control (3-2). As regards these control modes, the control discriminating portion 202 discriminates control, to be carried out, on the basis of a length of a driving time of the driving motor 207 necessary to change the residual toner storing amount of the collecting container 127 to the residual toner warning amount or less.

First, the total residual toner storing amount TotalDisTnr (g) after the printing of the image on the current sheet S is not the estimated amount as in Embodiment 1, but is a detected value by the residual toner amount detecting sensor 801, and the detected value is acquired by the residual toner amount acquiring portion 203. On the basis of the acquired residual toner amount, the control discriminating portion 202 determines, similarly as in Embodiment 1, the control mode based on the three ranges of the formulas (104), (105) and (106).

The process in the case where the formula (104) or (105) holds is similar to that in Embodiment 1. In the case where the formula (106) holds, extension of the sheet interval is not performed, but the driving speed of the driving motor 207 is increased, so that a feeding amount of the residual toner by the feeding screw 128 is increased. A feeding amount (feeding speed) per unit time IntTsDelSpd (g/s) of the feeding screw 128 needed at this time can be acquired by the following formula (301).

$$\text{IntTsDelSpd}=(\text{TotalDisTnr}-\text{DisTnrWarn})/\text{IntTime} \quad (301)$$

That is, in the case where the necessary driving time NeedTsOnTime (s) of the driving motor 207 is in the range of the formula (106), the print controller 201 accelerates the driving motor 207 so that the residual toner timing speed of the feeding screw 128 is IntTsDelSpd (g/s). In part (b) of FIG. 6, the feeding speed during the print process is indicated by TsDelSpd (g/s).

The image forming apparatus in this embodiment does not include the drive ratio acquiring portion 205, and therefore, an increase amount (collecting amount) of the residual toner collected in the case where the printing of the image on the subsequent sheet S cannot be estimated on the basis of the print ratio. In this embodiment, calculation of the residual toner warning amount DisTnrWarn (g) will be described.

In this embodiment, as the residual toner warning amount, a maximum amount of the residual toner increase amount assumable in the case where the printing of the image on the subsequent sheet S was carried out is assumed. That is, the residual toner warning amount calculating portion 206 sets, as the residual toner warning amount, a value obtained by subtracting the maximum of the residual toner increase amount from the full load amount of the collecting container 127. The maximum of the residual toner increase amount can be set on the assumption that the printing of the image on the sheet S is carried out with the print ratio of 100%.

Further, only for estimating the residual toner increase amount for the subsequent sheet S on the basis of the print ratio, the residual toner amount estimating portion 204 and the print ratio acquiring portion 205 are added to the print controller 201 and thus the residual toner warning amount can be calculated with accuracy.

According to this embodiment, the residual toner storing amount of the collecting container 127 is detected by the residual toner amount detecting sensor 801, so that control of the driving motor 207 in the sheet interval can be optimized. As a result, it is possible to prevent the collecting container 127 from overflowing with the residual toner while suppressing a lowering of productivity to a minimum. Further, the lowering of productivity can be further suppressed by increasing the driving speed of the driving motor 207 in the sheet interval.

As regards the image forming apparatus 101, the constitution in which the toner image was directly transferred from the photosensitive drum 109 onto the sheet S was described above. However, the present invention is also applicable to a constitution in which the toner image is transferred from the photosensitive drum 109 onto the sheet S via an intermediary transfer belt.

Further, the constitution in which the driving motor 207 driven the developing device 112 and the feeding screw 128 was described, but the present invention is not limited thereto. For example, a constitution in which the driving motor 207 drives the feeding screw 128 and at least either one of the photosensitive drum 109, the transfer roller 110 and the charging roller 111, in place of the developing device 112.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-229216 filed on Nov. 25, 2016, which is hereby incorporated by reference herein in its entirety.

What is claimed is:

1. An image forming apparatus comprising:

an image bearing member;

a charging unit configured to electrically charge said image bearing member;

a developing unit configured to deposit a developer on a surface of the charged image bearing member;

a transfer unit configured to transfer the developer from said image bearing member onto a recording material;

a collecting container configured to collect a residual developer remaining on the surface of said image bearing member without being transferred onto the recording material;

a developer feeding unit configured to feed, from said collecting container, the residual developer collected in said collecting container;

a driving motor configured to drive said developer feeding unit and at least one of said image bearing member, said charging unit, said developing unit and said transfer unit; and a control unit configured to change a driving speed of said driving motor depending on a storing amount of the residual developer in said collecting container in a period in which formation of an image on the recording material is not performed.

2. The image forming apparatus according to claim 1, wherein said control unit drives driving motor or stops drive of said driving motor depending on the storing amount of the residual developer in said collecting container in the period.

3. The image forming apparatus according to claim 1, wherein said control unit includes, an acquiring unit configured to acquire the storing amount of the residual developer in said collecting container, and a calculating unit configured to calculate a warning amount, of the residual developer, smaller than capacity of said collecting container, wherein when the storing amount of the residual developer exceeds the warning amount, said control unit drives said driving motor until the storing amount decreases to the warning amount or less.

4. The image forming apparatus according to claim 3, wherein said calculating unit calculates the warning amount on the basis of the capacity of said collecting container and a collecting amount of the residual developer collected by the formation of the image on the second recording material.

5. The image forming apparatus according to claim 4, wherein said calculating unit calculates the collecting amount of the residual developer on the basis of a print ratio in the formation of the image on the second recording material.

6. The image forming apparatus according to claim 3, wherein said control unit calculates a driving time, of said driving motor, necessary to decrease the storing amount of the residual developer to the warning amount or less.

7. The image forming apparatus according to claim 3, wherein said control unit extends the period until the storing amount decreases to the warning amount or less.

8. The image forming apparatus according to claim 3, wherein even in a case where the storing amount of the residual developer exceeds the warning amount, said control unit does not change the driving speed of said driving motor in a case where there is no recording material subsequent to the second recording material and the storing amount of the residual developer does not exceed the capacity of said collecting container even when a collecting amount of the residual developer collected by the formation of the image on the second recording material is added to the storing amount.

9. The image forming apparatus according to claim 1, wherein said control unit includes a predicting unit configured to predict the storing amount from at least one of a print ratio of the developer, a transfer efficiency of the developer onto the recording material and an amount of the residual developer fed by said developer feeding unit.

10. The image forming apparatus according to claim 1, further comprising a detecting unit configured to detect the storing amount.

11. The image forming apparatus according to claim 1, wherein said control unit increases the driving speed of said driving motor depending on the storing amount of the residual developer in said collecting container in the period.

12. The image forming apparatus according to claim 1, wherein the period is an interval period from an end of formation of an image on a first recording material to a start of formation of the image on a second recording material subsequent to the first recording material.

13. The image forming apparatus according to claim 1, further comprising a storing container configured to store the residual developer, wherein said developer feeding unit feeds the residual developer from said collecting container to said storing container.

14. An image forming apparatus comprising:

an image bearing member;

a charging unit configured to electrically charge said image bearing member;

a developing unit configured to deposit a developer on a surface of the charged image bearing member;

a primary transfer unit configured to transfer the developer from said image bearing member onto an intermediate transfer member;

a secondary transfer unit configured to transfer the developer from said intermediate transfer member onto a recording material;

a collecting container configured to collect a residual developer remaining on the surface of said image bearing member without being transferred onto the recording material;

a developer feeding unit configured to feed, from said collecting container, the residual developer collected in said collecting container;

a driving motor configured to drive said developer feeding unit and at least one of said image bearing member, said charging unit, said developing unit, said primary transfer unit and said secondary transfer unit; and a control unit configured to change a driving speed of said driving motor depending on a storing amount of the residual developer in said collecting container in a period in which formation of an image on the recording material is not performed.

15. The image forming apparatus according to claim 14, wherein said control unit drives said driving motor or stops drive of said driving motor depending on the storing amount of the residual developer in said collecting container in the period.

16. The image forming apparatus according to claim 14, wherein said control unit includes a predicting unit configured to predict the storing amount from at least one of a print ratio of the developer, a transfer efficiency of the developer onto the recording material and an amount of the residual developer fed by said developer feeding unit.

17. The image forming apparatus according to claim 14, further comprising a detecting unit configured to detect the storing amount.

18. The image forming apparatus according to claim 14, wherein said control unit increases the driving speed of said driving motor depending on the storing amount of the residual developer in said collecting container in the period.

19. The image forming apparatus according to claim 14, wherein the period is an interval period from an end of formation of an image on a first recording material to a start of formation of the image on a second recording material subsequent to the first recording material.

20. The image forming apparatus according to claim 14, further comprising a storing container configured to store the residual developer, wherein said developer feeding unit feeds the residual developer from said collecting container to said storing container.

* * * * *